US005913269A

United States Patent [19]

Franssen et al.

[11] Patent Number: 5,913,269

[45] Date of Patent: Jun. 22, 1999

[54] COLLAPSIBLE STAND FOR BEVERAGE CANS

[76] Inventors: Daniel J. Franssen, 6666 State Rd., Washington, Mo. 63090; Alan W. Inkenbrandt, 10301 Shaffer Rd., Evansville, Ind. 47720

[21] Appl. No.: 08/432,079

[22] Filed: May 1, 1995

[51] Int. Cl.[6] ..... A47B 3/00

[52] U.S. Cl. ..... 108/25; 108/150; 248/169; 248/171

[58] Field of Search ..... 108/25, 26, 50.11, 108/150, 153.1, 159, 128, 127, 50.12; 248/169, 171, 165

[56] References Cited

U.S. PATENT DOCUMENTS

| | | | |
|---|---|---|---|
| 351,649 | 10/1886 | Newman | 108/150 X |
| 361,527 | 4/1887 | Kazanjian | 248/171 X |
| 1,810,345 | 3/1931 | Collins . | |
| 2,036,113 | 2/1936 | Befera . | |
| 2,733,881 | 2/1956 | Threlfall et al. | 248/171 X |
| 2,805,109 | 9/1957 | Kopmar | 108/25 |
| 3,624,732 | 11/1971 | Bowden | 108/151 X |
| 3,665,867 | 5/1972 | Carlson et al. | 108/25 |
| 3,851,599 | 12/1974 | Bridges | 108/25 |
| 4,448,378 | 5/1984 | Binfare | 108/150 X |
| 5,131,716 | 7/1992 | Kwasnik et al. . | |
| 5,165,639 | 11/1992 | Knuppe . | |
| 5,197,394 | 3/1993 | Schmidt | 108/50 |
| 5,249,770 | 10/1993 | Louthan . | |
| 5,335,803 | 8/1994 | O'Brien et al. | 108/50 X |
| 5,353,716 | 10/1994 | Wilbert | 108/159 X |

FOREIGN PATENT DOCUMENTS

| | | | |
|---|---|---|---|
| 503098 | 3/1939 | United Kingdom | 248/171 |

*Primary Examiner*—Jose V. Chen
*Assistant Examiner*—Janet M. Wilkens
*Attorney, Agent, or Firm*—Robbins & Robbins

[57] ABSTRACT

A collapsible stand for holding beverage cans or the like is provided. The stand is comprised of a table top or deck having cup shaped openings for receiving beverage cans. A collapsible supporting stand is removably connected by a column to the table top. The supporting stand has a collapsible tripod support in order that the stand may be supported on the ground. The tripod is comprised of a base member connected to the bottom of the column and three legs pivotably connected to a yoke slidable along the column. As the tripod is erected or collapsed the legs slide through openings in the base to effect an erect or collapsed position.

8 Claims, 3 Drawing Sheets

78
82
50
80

94
94
52
90

66
68
82
70
80

94
66
60
64

94
92
90

74
46
34

80
68
17
17
66
70

76
60

46
47
76

72
60
74

34
60
74
75

76
34

92
66
66
60
74

COLLAPSIBLE STAND FOR BEVERAGE CANS

BACKGROUND OF THE INVENTION

In the past there has been a need for providing a beverage stand for various outdoor activities. Such activities vary over a wide range of occasional usage where beverages are consumed such as groups gathered around a horse shoe match, badminton, croquet, on the lawn or patio and the like.

While collapsible card tables, small stationary tables have been employed, their use and storage has been inconvenient and their flat surface has made the support of beverage cans risky where the ground is uneven.

There has remained a problem in providing a convenient rest place or beverage stand which may be readily installed in the field and collapsed for storage.

SUMMARY OF THE INVENTION

By means of this invention, there has been provided a beverage can stand which can be simply erected in the field and collapsed for storage. The can stand provides a table-like deck surface with cup shaped openings for receiving beverage cans, with or without can insulation, glasses and the like for use in outdoor activities, the patio or other areas as desired. The beverage can stand is comprised of a table top or deck which may be removably supported upon a collapsible support stand.

The can stand is supported by a removable upright support stand. The support stand has a collapsible tripod base for resting upon a ground surface. The table top portion of the stand is removable from the upright portion of the stand and may be used as a tray for transporting the beverage cans, rested on the ground for picnic style users and the like.

The tripod is comprised of a base member connected to the bottom of the column and three legs pivotably connected to a yoke slidable along the column. As the tripod is erected or collapsed the legs slide through openings in the base to effect an erect or collapsed position.

The beverage can stand is simply erected, can be used at various height levels and when not in use, may be disassembled, collapsed and stored in a minimum of space.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
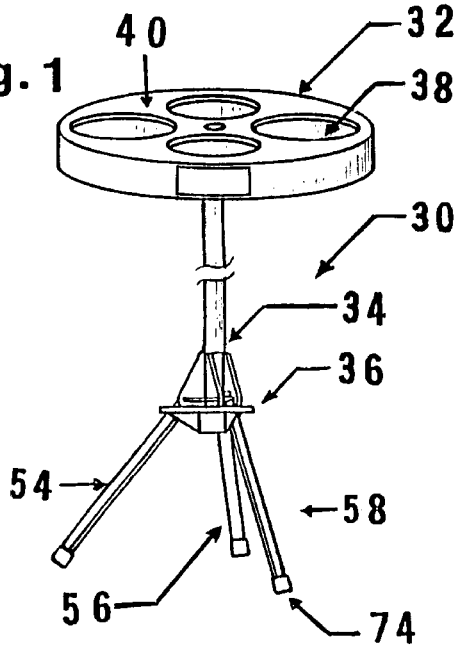
FIG. 1 is a pictorial view of the collapsible stand in erected position.

The stand of this invention is generally indicated by the reference numeral 30 in FIG. 1 where it is shown in the erected position. It is comprised of a table top 32 supported by an upstanding column 34 from a collapsible tripod 36. All the parts are made of plastic such as polyvinyl chloride or the like, for simplicity in construction, freedom from maintenance, superior weathering and relatively low cost.

The table top 32 as best shown in FIGS. 2–5 is comprised of molded plastic, such as for example polyvinyl chloride and has cup-shaped depressions 38 depending from a flat top 40. The cup shaped depressions are of a size to receive a conventional beverage can, although it will be understood that glasses, plastic cups of the like may be used as desired. The table top is further provided with a downwardly depending peripheral flange 42 to provide strength and rigidity.

In order to be removeably supported from the column 34 the table top has a socket 43 extending from the flat top 40. The socket has a slot 44 which receives tabs 46 on the top 47 of the column in order that the column may be inserted in the socket, twisted and retained in the slot. For disconnection and storage, the reverse procedure is followed when the stand is to be disassembled. The socket and top of the column showing this feature is best shown in FIGS. 2, 5, 8 and 9.

Figure 2:
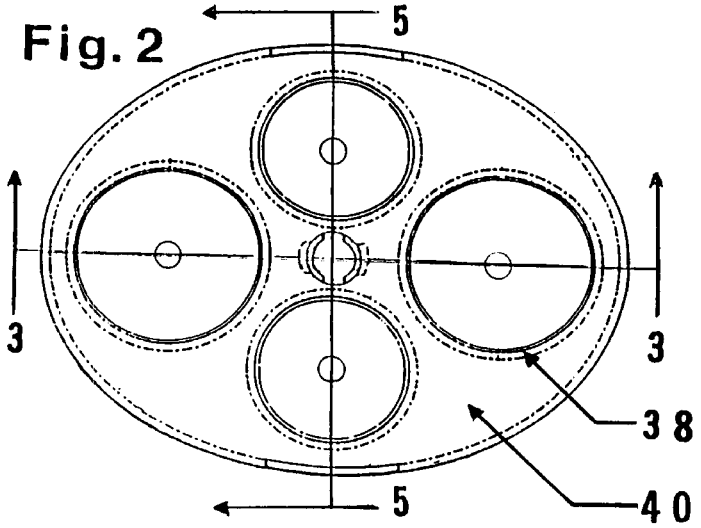
FIG. 2 is an enlarged top plan view of the table portion of the stand.
Figure 5:
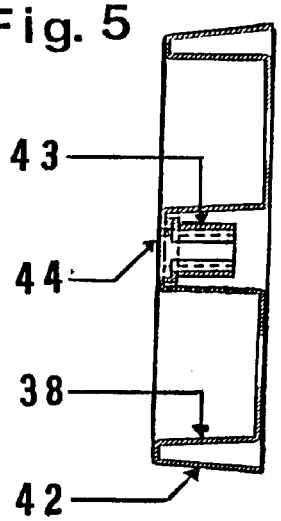
FIG. 5 is a view in section taken on line 5—5 of FIG. 2.
Figure 3:
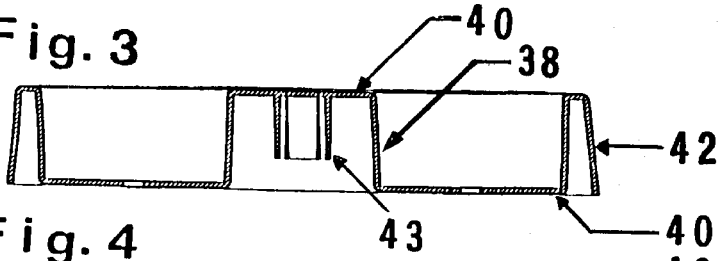
FIG. 3 is a view in section taken on line 3—3 of FIG. 2.
Figure 6:
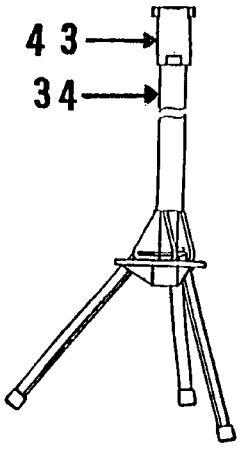
FIG. 6 is an interrupted view of the column and leg portion erected.
Figure 4:
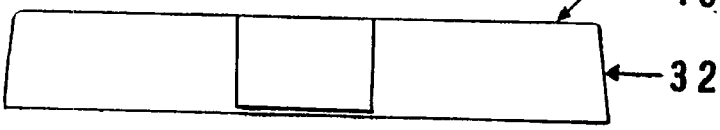
FIG. 4 is a view in front elevation of the table portion.

The collapsible tripod 36 is comprised of a base 50 secured to the bottom of the column and a yoke 52. The yoke receives top ends of the three legs 54, 56 and 58 of the tripod in hinged relation upon axles 60, 62 and 64. The legs are slidably fitted through openings 66, 68 and 70 of the base 50 from the erected position of FIG. 6 and the collapsed position of FIG. 7.

The holes 66, 68 and 70 in the base 50 are radially distanced from the axis of the column 34 slightly greater than the radial distance of the axles 60, 62 and 64 from the axis of the column. It is this feature that causes the legs to spread from the collapsed position shown in FIG. 7 to the erected position of FIG. 6.

The legs 54, 56 and 58 are best shown in FIGS. 11–14. They have a T-bar cross section body 72 for rigidity. At the bottom ends they have circular ribs 74 which receive rubber pads 75 which act as a support on the ground and as stops for the legs in the collapsed position shown in FIG. 7 to limit the base 50 and column 34 from extending past the collapsed position.

Figures 8, 9, 10, 11, 12, 13, 14, 15, 16, 17, 18, 19, 20, 21:
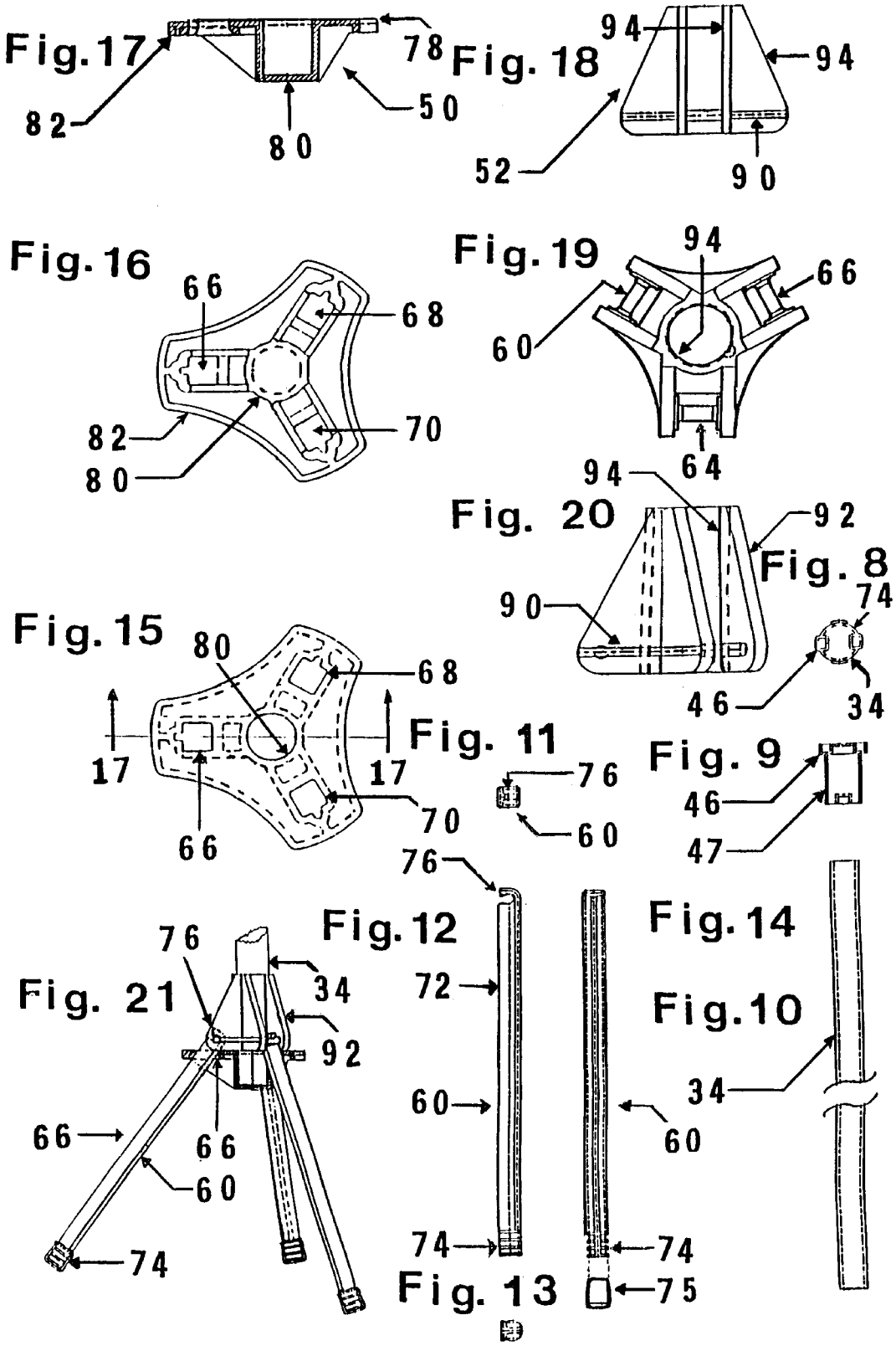
FIG. 8 is a top plan view of the column top.
FIG. 9 is a view in vertical section of the column top.
FIG. 10 is a view in elevation partially broken away in section showing the column.
FIG. 11 is a top plan view of a leg.
FIG. 12 is a right side view in elevation of the leg.
FIG. 13 is a bottom plan view of the leg.
FIG. 14 is a view in front elevation of the leg.
FIG. 15 is a top plan view of the base for the column.
FIG. 16 is a bottom plan view of the base.
FIG. 17 is a view in section taken on line 17—17 of FIG. 15.
FIG. 18 is a view in front elevation of the yoke.
FIG. 19 is a top plan view of the yoke.
FIG. 20 is a view in elevation of the yoke rotated 60° to the right.
FIG. 21 is a view partially broken away showing the legs and column in erected position.
Figure 23:
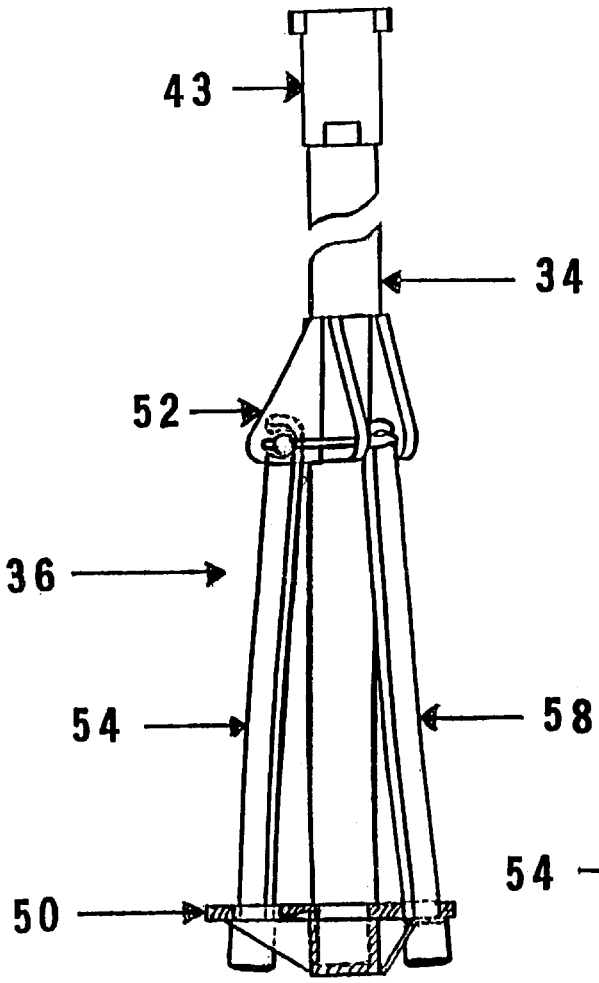
FIG. 23 is a view similar to FIG. 22 showing the legs and column in collapsed position.
Figure 22:
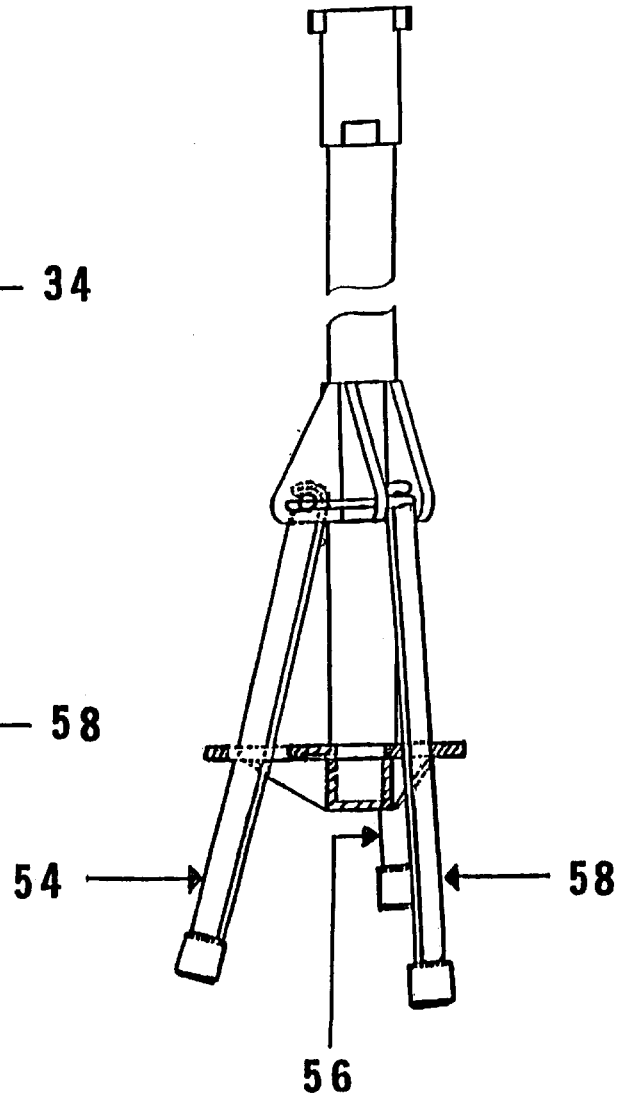
FIG. 22 is an enlarged view similar to FIG. 21 showing the legs and column in an intermediate position of adjustment.

The top of the legs have a lip 76 which as shown in FIG. 21 fits around the axles 60, 62 and 64. This construction provides for retention of the legs by the yoke while permitting rotation with respect to the yoke and base from the erected position of FIG. 6 to the collapsed position of FIG. 7.

The base 50 is best shown in FIGS. 15–17 and 21. It has a flat top 78 with a downwardly depending socket 80 in which the bottom end of the column 34 is anchored such as by gluing or other conventional means. A flange 82 provides rigidity. In order to accommodate the sliding interfit of the legs 54, 56 and 58 which are rotably connected to the yoke the three T-shaped holes 66, 68 and 70 are provided. These are of a size to permit the legs to slide freely as the stand is erected and collapsed while providing a bearing surface on the edges of the holes in the tripod erected position as best shown in FIG. 21.

The yoke 52 is best shown in FIGS. 18–21. It has a flat bottom 90 with upstanding ribs 92 which support axles 60, 62 and 64 upon which the legs are journalled by the lip 76 for relative rotation from the collapsed to the erected position. A circular opening 94 slidably receives the column as the tripod is adjusted.

USE

The stand 30 of this invention is very simply erected and collapsed for use indoors or outdoors. Beverage containers such as beverage cans, glasses, cups, bottles or the like are simply placed in the beverage receptacles where because of the cup-like depressions 38 they are retained safely against spillage.

Figure 7:
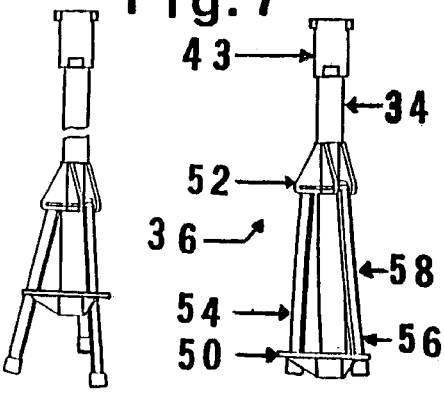
FIG. 7 is a view similar to FIG. 6 showing the collapsed position.

The collapsed position shown in FIG. 7 may be used for storage or, for economy of space, the column 34 may be simply removed from the socket 43 by twisting and withdrawing.

For erection of the stand to the position shown in FIG. 1, the table top 32 is held in one hand with the base 50 being held in the other hand. They are then pushed toward one another. This pressure causes the leg 54, 56 and 58 to slide through the holes 66, 68 and 70 in the base 50 and expand to the erected position shown in FIGS. 1 and 6. Since the holes in the base are spaced from the axis of the column, a greater distance than the pivot point of the legs on the axles 60, 62 and 64, they are spread apart to the desired tripod position.

In the erected position the legs 52, 54 and 56 bear against the edges of the holes 66, 68 and 70 in the base 50 in such a manner that when the erected stand is placed on the ground a firm and stable positioning is obtained that will withstand load pressure placed upon the table top.

When the erected stand is desired to be collapsed, the table top 32 or upper portion of the column 34 is simply held in one hand while the other hand pushes the bottom portion of the legs or the pads 75 toward the table top. This causes the legs 54, 56 and 58 to slide through the openings 66, 68 and 70 and move the legs and yoke 52 toward the table top to the collapsed position shown in FIG. 7. After collapsing the column may be removed from the table top as previously described for further economy of space in storage.

While the use of the beverage can stand portion has been described with regard to erected use with the upright vertical stand, the table top or deck portion may be used alone without the column and tripod such as by resting upon the ground or upon a portion of a boat seat or deck and used as a tray.

Various changes and modifications may be made within this invention as will be apparent to those skilled in the art. Such changes and modifications are within the scope and teaching of this invention as defined in the claims appended hereto.

What is claimed is:

1. A stand for holding beverage containers, said stand being comprised of a table member for holding said beverage containers and a support stand having a lower ground engaging end and upper end engaging table member, said table member having openings in the form of cup shaped receptacles for receiving said beverage cans and said support stand comprising an upstanding column having an upper end removably connected to said table member, the upper end of the column being removably received in a socket in the bottom of the table member and a lower end being comprised of a collapsible tripod base having three legs which in a collapsed position are substantially axially positioned with respect to said column, the table member being comprised of a plastic deck having a downwardly depending peripheral flange for strengthening the table member, the table member having a substantially flat ground engaging surface comprised of the bottom of said flange and bottom walls of said flange being at least of substantially the same depth as said cup shaped receptacle and said table member being employed as a tray when removed from the socket.

2. The stand of claim 1 in which the collapsible tripod is comprised of a flat base secured to the bottom of said column and a yoke having a central opening through which said column is slidably fitted, said yoke being provided with a plurality of axles rotatably supporting said legs and said base having a plurality of openings receiving said legs in slidable relation.

3. The stand of claim 2 in which the base closely underlies said yoke in a stand erected position and is moveable away from said yoke in a stand collapsed position.

4. The stand of claim 2 in which said openings are radially spaced from a vertical axis of the column a greater distance than the radial distance of said axles from said column axis.

5. The stand of claim 4 in which said openings have a cross-section generally congruent to a cross-section of said legs and are sufficiently larger to permit free sliding therethrough between an erected and collapsed position and yet cause a bearing between the legs and the openings in a fully erected and partially erected position.

6. The stand of claim 1 in which the collapsible tripod is comprised of a flat base secured to the bottom of said column and a yoke having a central opening through which said column is slidably fitted, said yoke being provided with a plurality of axles rotatably supporting said legs and said base having a plurality of openings receiving said legs in slidable relation and said openings are radially spaced from a vertical axis of the column a greater distance than the radial distance of said axles from said column axis.

7. The stand of claim 6 in which said openings have a cross-section generally congruent to a cross-section of said legs and are sufficiently larger to permit free sliding therethrough between an erected and collapsed position and yet cause a bearing between the legs and the openings in a fully erected and partially erected position.

8. The stand of claim 7 in which the stand is molded from a plastic material for resistance to weathering, freedom from maintenance and economy in production cost.

* * * * *